US006277552B1

(12) United States Patent
Elst et al.

(10) Patent No.: US 6,277,552 B1
(45) Date of Patent: Aug. 21, 2001

(54) SHALLOW ELECTRON TRAP DOPANTS IN SILVER HALIDE TABULAR GRAIN EMULSIONS FOR USE IN MEDICAL DIAGNOSTIC IMAGING MATERIALS

(75) Inventors: Kathy Elst, Lier; Yves Vanmeenen, Lokeren; Dirk Vandenbroucke, Boechout, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/566,382

(22) Filed: May 8, 2000

Related U.S. Application Data

(60) Provisional application No. 60/137,231, filed on Jun. 1, 1999.

(30) Foreign Application Priority Data

May 25, 1999 (EP) ..... 99201625

(51) Int. Cl.[7] ..... G03C 1/035
(52) U.S. Cl. ..... 430/567; 430/605
(58) Field of Search ..... 430/605, 567

(56) References Cited

U.S. PATENT DOCUMENTS 5,132,203 7/1992 Bell et al. .
5,518,871 * 5/1996 Urabe ..... 430/605
5,691,127 * 11/1997 Daubendiek et al. ..... 430/605
5,773,208 * 6/1998 Hall et al. ..... 430/605

FOREIGN PATENT DOCUMENTS 0 712 033 5/1996 (EP) .
0 743 553 11/1996 (EP) .

OTHER PUBLICATIONS

Patent Abstract of Japan, Derwent Publications, Section Ch, Week 199405, Class E12, AN 1994–037623, XP002121375 & JP 05 341426 A (Konica Corp.), Dec. 24, 1993.
Patent Abstract of Japan, Derwent Publications, Section Ch, Week 199544, Class G06, AN 1995–341180, XP002121415 & JP 07 234468 A (Konica Corp.), Sep. 5, 1995.
Patent Abstract of Japan, Derwent Publications, Section CH, Week 199511, Class G06, AN 1995–078844, XP002121416 & JP 07 005605 A (Konica Corp.), Jan. 10, 1995.

* cited by examiner

*Primary Examiner*—Hoa Van Le
(74) *Attorney, Agent, or Firm*—Breiner & Breiner, L.L.C.

(57) ABSTRACT

A light-sensitive silver halide photographic emulsion has been disclosed, said emulsion comprising a binder and core-shell tabular grains, wherein said core is more rich in silver bromide than said shell, characterized in that said grains contain, in the core thereof representing an amount of precipitated silver halide extending up to less than 50% of all precipitated silver halide, a ruthenium complex compound as a sole complex compound providing shallow electron traps.

10 Claims, No Drawings

SHALLOW ELECTRON TRAP DOPANTS IN SILVER HALIDE TABULAR GRAIN EMULSIONS FOR USE IN MEDICAL DIAGNOSTIC IMAGING MATERIALS

This application claims benefit of Provisional No. 60/137,231 filed Jun. 1, 1999.

FIELD OF THE INVENTION

The present invention relates to a light-sensitive silver halide photographic emulsion particularly suitable for use in single-side and double-side coated radiographic materials.

BACKGROUND OF THE INVENTION

Tabular silver halide grains are grains possessing two parallel crystal faces with an aspect ratio of two or more. Said aspect ratio is defined as the ratio between the diameter of a circle having an equivalent surface area as one of these crystal faces, and the thickness, being the distance between the two major faces.

Tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966,p.66–72. Early patent literature includes U.S. Pat. Nos. 4,063,951; 4,067,739; 4,150,994; 4,184,877 and 4,184,878. However the tabular grains described herein cannot be regarded as showing a high diameter to thickness ratio, commonly termed aspect ratio. In a number of U.S. Patents filed in 1981 and issued in 1984 tabular grains with high aspect ratio and their advantages in photographic applications are described as e.g. U.S. Pat. Nos. 4,434,226; 4,439,520; 4,425,425 and 4,425,426 and in Research Disclosure, Volume 225, January 1983, Item 22534.

Anisotropic growth characteristics for the said tabular grains are known to be due to the formation of parallel twin planes in the nucleation step of the precipitation and as a global result fairly heterogeneous emulsion crystal distributions are obtained: a common variability coefficient (defined as a ratio between average standard deviation on equivalent circular diameter and the said average equivalent circular diameter) of 0.30 to 0.60 is calculated, partly due to the presence of quite a large number of non-tabular grains having a sphere equivalent diameter of less than 0.3 $\mu$m. Moreover differences in thickness growth are observed, said differences leading to unevenness as a consequence of observed differences in image tone.

Heterodispersity of grain morphology further leads to e.g. uncontrolled chemical and spectral sensitization, lower contrast and lower covering power, thereby losing typical advantages of the said grains as referred to hereinbefore.

Until now efforts in order to get more monodisperse tabular silver halide crystal distributions in emulsion preparation have been directed towards silver halide crystals rich in silver bromide as has e.g. been described in U.S. Pat. Nos. 4,797,354; 5,147,771; 5,147,772; 5,147,773; 5,171,659; 5,248,587; 5,204,235; 5,210,013; 5,215,879; 5,250,403; 5,252,442, 5,252,453; 5,254,453; 5,318,888; 5,439,787; 5,472,837; 5,482,826 and 5,484,697 and in Research Disclosure No. 391, p. 713–723 (1996).

Many attempts have been made in order to improve the degree of homogeneity of the size and shape of the crystals but the majority of them is related with tabular grains rich in silver bromide. So radiographic materials comprising emulsions having monodisperse tabular silver brom(oiod)ide crystals have e.g. been described in U.S. Pat. Nos. 5,252,442 and 5,508,158.

Combinations of intensifying screens provided with luminescent phosphors and light-sensitive silver halide photographic materials are conventionally used for medical diagnosis. By X-ray radiation the luminescent phosphors in the screen panel or panels are converting X-rays into visible radiation, thereby exposing the film material in contact with the said panel (for single-side coated materials as e.g. in mammography) or panels (for duplitized or double-side coated materials as e.g. in chest imaging). So in mammography e.g. the compressed breast is irradiated with soft X-rays emitted from an X-ray generating device and the modulated X-rays are detected with a radiographic X-ray conversion screen, also called intensifying, fluorescent screen or "phosphor screen". The X-ray conversion screen comprises a luminescent phosphor which converts the absorbed X-rays into visible light and the emitted visible light exposes a silver halide film that is brought into contact with said X-ray conversion screen. After film processing, comprising the steps of developing, fixing, rinsing and drying, a mammogram is obtained which can be read on a light box. No other field of medical radiology demands such a high level of image quality as mammography and the ability of the mammogram to portray relevant diagnostic information is highly determined by the image quality of the screen-film system. Image quality is manifested by a number of features in the image including sharpness, noise, contrast, silver image colour and skin line perceptibility. Conventional mammography films can roughly be classified in low and high contrast types according to the value of their average gradation as defined above. The low contrast type can be characterized by a relatively low average gradation ranging from 2.0 to 2.5 whereas the average gradation of the high contrast type may range higher than 3.0. Often, high contrast films are preferred because of the higher ability to detect tiny cancers deep in the glandular tissue of the breast. If the contrast is too high, however, it may preclude visualization of both thin (i.e. the skin line) and thick tissues (i.e. the inside of the breast) in the same image due to lack of exposure latitude. Therefore, some radiologists prefer low contrast mammography films. When the contrast is low, skin line perceptibility is excellent, but then the chance of missing possibly malignant breast lesions is high. Thus a balance has to be found between contrast and exposure latitude and an example of this approach has been described in U.S. Pat. No. 5,290,655. At first sight tabular grains would be judged not to be able to satisfy all those requirements, especially with respect to contrast.

Maintaining the said contrast and image definition related therewith at a constant level is becoming another requirement of facilities performing mammography. Accordingly, quality control tests are executed on a regular basis in order to monitor the consistency of the performance of the X-ray equipment, the image receptors and the film processor. In order to minimize the influence of varying film processing time, temperature, chemistry and replenishment, a preferred mammography film requires a stable speed and contrast with regard to these processing parameters. As in addition, there is a general trend in the field of radiology to shorten the film processing time and likewise in the field of mammography, being driven by intensified screening programs, the interest has focused on rapid access of mammograms. As a consequence, mammography films are preferred which comprise silver halide crystals that can be processed rapidly and consistently in a dry-to-dry processing cycle of 90 seconds or less and therefore, most mammography films today comprise good developable cubic silver halide crystals. As described in EP-A 0 712 036 such cubic crystals show a stable speed and contrast upon varying processing parameters, but said cubic grain emulsions however are characterized by a very high contrast, resulting in a poor skin line perceptibility. Especially in rapid processing applications it is very difficult to obtain the desired low fog, high speed and high covering power simultaneously. Replacing cubic grain emulsions by tabular grain emulsions, although being favourable with respect to high covering power obtainable at moderate coating amounts of silver halide as has been demonstrated e.g. in U.S. Pat. No. 4,414,304, shows the disadvantageous lower contrast than the contrast obtainable with cubic grains, besides the appearance of a brown colour hue of developed crystals and the residual colouration of the processed image, especially in short processing cycles, due to strong adsorption of huge amounts of spectral sensitizing dye(s) at the large specific surface area, characteristic for the said tabular grains.

Making use of a mixture of cubic and tabular grains or of a multilayer arrangement of cubic and/or tabular grains in order to provide a good image tone as in EP-A 0 874 275 and in EP-A 0 770 909 respectively is more complex and less interesting from the point of view of reproducibility of the production process. As tabular grain emulsions having a high aspect ratio are known to provide, over more conventional cubic, octahedral or spherical grains, a high covering power and, as a consequence thereof, a lower coating weight, manufacturing costs are reduced. Said lower coating weight is especially preferred if rapid processing applications, preferably accompanied by low replenishing amounts of developer and fixer, are required, which is nowadays an ever more returning demand. Attaining the desired contrast however, even with lower coating amounts is another problem that should be overcome.

OBJECTS OF THE INVENTION

Therefore it is an object of the present invention to provide a light-sensitive spectrally sensitized {111} tabular silver halide emulsion having crystals or grains providing the desired contrast without loss of speed in diagnostic imaging, making use from (intensifying) screen-film combinations wherein single-side coated as well as double-side coated materials comprising said tabular is grains are coated, in combination with one or two screens respectively.

Further objects and advantages of the present invention, which may be obtained by specific embodiments, will become apparent from the description hereinafter.

SUMMARY OF THE INVENTION

A light-sensitive silver halide photographic emulsion has thus been provided, said emulsion comprising a binder and core-shell tabular grains, wherein said core is more rich in silver bromide than said shell, characterized in that said grains contain, in the core thereof representing an amount of precipitated silver halide extending up to less than 50% of all precipitated silver halide, a ruthenium complex compound (more preferably a (hexa)cyanate salt complex of ruthenium) as a sole complex compound providing shallow electron traps. A single-side or double-side coated silver halide photo-graphic material has also been disclosed, said material comprising a support and coated thereon one or both sides respectively one or more hydrophilic light-sensitive layers, wherein at least one of said layers comprises a light-sensitive silver halide emulsion according to the present invention.

DETAILED DESCRIPTION OF THE INVENTION

Quite unexpectedly it has become clear from our experiments that when a light-sensitive emulsion is built up as a core-shell tabular grain emulsion comprising a binder and core-shell tabular grains or crystals having a ruthenium complex compound as a sole dopant compound providing shallow electron traps in the core extending up to less than 50% of all precipitated silver halide that materials coated in light-sensitive layers with such emulsions clearly show the desired effect of increased contrast (gradation), without loss of speed (sensitivity) versus in the absence thereof.

According to the present invention said sole compound providing shallow electron traps (SET's) in the core-shell tabular grains of the emulsion according to the present invention is a ruthenium complex compound, and more particularly, in a more preferred embodiment, a ruthenium (hexa)cyanate complex compound. In general a metal ligand complex (as the ruthenium cyanate complex present in the core of the tabular grains rich in silver bromide) used as sole shallow electron trap providing complex compound in the said core, is a compound providing shallow electron traps (SET's) if all ligands in the metal complex are more electronegative (situated more to the right side of the spectrophotometrical series), opposite to those providing more permanent trapping centres when a ligand is becoming less electronegative whereby the trap depth of the metal complex dopant will increase. At any time the specific activity of the ruthenium dopants in silver halide crystals of emulsions according to the present invention can be clearly demonstrated by using the EPR (electron paramagnetic resonance technique), the technique and sample preparation of which has been extensively described in U.S. Pat. No. 5,457,021 by Olm et al and by H. Vercammen, T. Ceulemans, D. Schoenmakers, P. Moens and D. Vandenbroucke in Proc. ICS&T of $49^{th}$ Ann. Conf., p.54 (Minneapolis, May, 19–24, 1996) or by the ENDOR (electron nuclear double resonance) technique, described in the same Proc. Ann. Conf., p.56 by P. Moens, H. Vercammen, D. Vandenbroucke, F. Callens and D. Schoenmakers. Shallowly trapped photoelectrons indeed give rise to an EPR signal, which is composed of a single line, with a g value that is characteristic for the local grain composition. As has been shown by R. S. Eachus, M. T. Olm, R. Janes and M. C. R. Symons, Phys. Stat. Sol. 152, 583 (1989), the g value of the shallowly trapped electron in AgCl is 1.880±0.001 and for AgBr is 1.49±0.02. So the g value in EPR is characteristic for each examined species and can be calculated and measured as described in, e.g., *Electron Paramagnetic Resonance: Techniques and Applications,* by Raymond S. Alger, (1968) published by Interscience publishers, New York. The width of the line, as a function of temperature and concentration of the added dopant complex, has been described by H. Vercammen, D. Schoemaker, D. Vandenbroucke, Proceedings of the 1997 *International Symposium on Silver Halide Imaging,* Victoria—BC, Canada, 1997, pp. 125. In that reference the line width of the EPR signal of shallowly trapped electrons at 20 K is quoted to be 1.0±0.1 mT for a dopant concentration of 1 ppm. This parameter (line width) can be used as a thorough check of the concentration of the dopant which is effectively built in.

According to the present invention said compound providing shallow electron traps is present in amount of from 1 p.p.b. up to 100 p.p.m. versus silver, and, more preferably in an amount of from 10 up to 100 p.p.m. In a further preferred embodiment of the present invention the core of the light-sensitive silver halide photographic emulsion, more rich in silver bromide than the shell, represents an amount of precipitated silver halide extending up to less than 50% of all precipitated silver halide, and more preferably even up to at most 40% of all silver halide precipitated.

Ruthenium ion complexes providing shallow electron traps desired in order to reach the objects of the present invention, also called dopants, are e.g. those described in an interesting survey of Research Disclosure, Item 36736 (November 1994). Recommended SET's, besides the ruthenium (hexa)cyanate complex compound(s) are e.g. metal-halogen-fluorine complexes, more preferably hexafluoro coordinated iridium ion complexes described in EP-A 0 945 755, which are also advantageously added to the emulsion of the present invention. The complex compound dopants disoclosed therein are commonly added in significantly lower amounts to the tabular grains rich in silver bromide coated in emulsion form in one or more hydrophilic layers of the material according to the present invention than as e.g. spectral sensitisers and are thereby causing much less chemical load of the image-forming system of the present invention. Said dopants can in principle be added in whatever a stage of the emulsion preparation, provided that those dopants are not present in a shell outside the core rich in silver bromide and extending up to less than 50% (and in a preferred embodiment outside the core extending up to 40%) of all silver precipitated. This is clearly opposite to the localized phase of the cyanocomplexes of metals comprising metals of group VIII in the surface of the grains as disclosed in EP-A 0 613 044 or just beneath the surface layer having a thickness in the range of from 20 to 350 Ä as disclosed in EP-A 0 503 736 or in EP-A 0 743 553, situated in an interior grain portion separated from an iridium containing grain portion by at least 10% of the silver forming the grain structure. Generally dopants have little influence on crystal distributions in the emulsions but they may be added to cause advantageous effects with respect to reciprocity, pressure sensitization, etc.

According to the present invention complex ion compounds of ruthenium are incorporated in a limited part of the core portion, preferably the ruthenium cyanate salts thereof, and more preferably the ruthenium hexacyanate salt is particularly recommended as dopant(s) for the said core-shell tabular grain emulsions rich in silver bromide: in the presence of a sole complex ion compound as the preferred $[Ru(CN)_6]^{4-}$, in the core of the core-shell tabular grain, wherein said core is more rich in silver bromide than the shell, it is possible to reach the objects of the present invention, more particularly to reach the desired enhanced contrast without loss in speed.

The non-uniform distributrion of said sole complex ion compounds providing shallow electron traps plays a dominant role and when the tabular grains rich in silver bromide are described as core-shell tabular grains this means that the core thereof contains shallow electron trap dopants as ruthenium compounds mentioned hereinbefore, whereas the shell is completely free thereof. This further means that in the emulsion crystals according to the present invention the dopants providing shallow electron traps can be added from the start of the nucleation step until addition less than 50% of the total amount of silver (thus during part of the growth step) and before addition of at least the other 50% of silver salt in order to build up the shell of the core-shell tabular grain, wherein said shell has a lower content of silver bromide, in that part of the silver bromide has been replaced by silver iodide and, optionally by silver chloride, so that the tabular grains have a silver bromoiodide or bromochloroiodide composition. It may be advantageous to add hole trapping dopants chosen from carboxylic (formic) acid (salts) and α-hydroxy sulfenic acid (salts) described in EP-Application No. 98204079, filed Nov. 30, 1998 in order to get further improved sensitometric properties. As silver iodide present in the core-shell tabular grains of the present invention is divided non-homogeneously over the crystal volume it is preferred that all silver iodide is concentrated in the outer shell of the core-shell tabular grain, wherein said outer shell represents at least 50% of all silver precipitated and wherein said iodide is present in an enhanced amount in order to get an average silver iodide content over the whole grain volume of less than 3 mole %.

In a further preferred embodiment according to the present invention said grains have silver bromide in an average amount of at least 95% and even up to 99 mole % of silver bromide, although even higher amounts of bromide are not excluded. Further according to the present invention said grains have silver iodide in an average amount over the grain volume of at most 3 mole %, more preferably at most 1 mole %. Although preferred with respect to intrinsic and to spectral sensitivity it is recommended to limit average iodide concentrations to low levels as disclosed hereinbefore as higher concentrations retard development and lead to unsatisfactory sensitivities. Moreover the velocity of fixation can be disturbed in that case and as a consequence residual colouration may be unavoidable.

More details about grain modifying conditions (nucleation step, growth steps, physical ripening steps, also called Ostwald ripening steps inbetween or at the end) and adjustments during silver halide precipitation of tabular grain emulsions and specifically with respect to the introduction of dopants can be found in Section I-D of Research Disclosure 38957, published September 1996.

It is clear that special attention should be paid to the way in which the ruthenium complex compound dopant providing shallow electron traps are introduced during crystal growth as the stability of the dopants in complex compounds may be limited, depending on the solutions wherein the said compounds are available. Therefore said solution can be introduced by means of a so-called "third-jet" in order to introduce the dopant in the reaction vessel where rapid incorporation in the growing crystals is performed. In a preferred embodiment e.g. said third-jet is adding the dopant solution in the vicinity of the stirrer, where also new rapidly dissolving fine grain nuclei are formed which are precipitated further onto growing tabular crystals rich in silver bromide.

It has further been established that addition of small amounts of e.g. iridium compounds (as potassium hexachloroiridate (III)) added after ending precipitation and/or in the chemical ripening step may lead to a positive effect on processing latitude, in that e.g. less differences in sensitivity and gradation are observed after fluctuations in developing time within a range of about 5 seconds and in processing temperature within a range of about 10° C.

In a preferred embodiment tabular grains according to the present invention have a {111} crystal habit with an aspect ratio of more than 2, an average equivalent crystal diameter of at least 0.5 μm, an average thickness of from 0.06 to 0.30 μm and wherein said grains account for a total projected area of at least 90% with respect to all grains. In an even more preferred embodiment said tabular grains having a {111} crystal habit have an aspect ratio of from 5 to 20, an average equivalent crystal diameter of from 0.5 μm up to 5 μm (more preferably from 0.5 μm up to 3 μm), an average thickness of from 0.06 to 0.30 μm (more preferably from 0.06 μm up to 0.2 μm and even more preferably up to 0.15 μm) and wherein said grains account for a total projected area of at least 90% and even more with respect to all grains.

Further according to the present invention the emulsion has tabular grains having a hexagonal {111} crystal habit with a procentual variation coefficient on average crystal diameter of 25% or less and more preferably 20% or less.

Emulsions according to the present invention can be prepared as those described in U.S. Pat. No. 5,595,864, but methods, providing relatively narrow grain size distributions which can be applied are e.g. U.S. Pat. Nos. 5,290,655 and 5,693,459 and EP-A's 0 518 066 and 0 577 886.

To tabular silver bromo(chloro)iodide emulsion grains, wherein after precipitation and redispersion said grains are also called "primitive" or "unripened" as long as no chemically sensitizing agent is present, addition of chemical ripening agents is further required in order to make them, in a first step after precipitation, washing and redispersing procedures sensitive to irradiation exposure.

With respect to the chemical ripening process besides the commonly used sulphur and gold compounds the use of selenium sensitizers has been promoted, especially during the last decade, and even more recently tellurium compounds are frequently recommended. Patent literature related with the chemical ripening of tabular emulsion grains rich in silver bromide can be found e.g. in EP-A's 0 476 345, 0 831 363, 0 862 088 and 0 895 121 and in U.S. Pat. Nos. 5,004,679; 5,348,850; 5,654,134; 5,773,901; 5,807,667, without however being limited thereto.

Preferred unstable selenium compounds are e.g. those selected from the group consisting of substituted selenoureum, substituted triphenylphosphine selenide, substituted and unsubstituted triphenylorthophosphate selenide and substituted selenothiazine compounds.

Said selenium sensitisers are preferably used together with other sensitisers as at least gold and optionally sulphur. Especially useful labile compounds providing sulphur are therefore e.g. sodium thiosulphate, tetramethylthiodithioacetic acid diamide and further dimethylaminodithiomercaptane, thiosulphates or thiosulphonates. Other useful compounds which may be applied are those as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968).

As described in said literature chemical sensitization can be carried out by effecting the ripening in the presence of small amounts of compounds containing sulphur as e.g. thiosulphate, thiocyanate, thioureas; sulphites, mercapto compounds, rhodamines etc., wherein combinations of gold-sulphur ripeners together with the required selenium sensitisers are the most preferred. Addition of tellurium compounds as e.g. tellurosulphate, tellurocyanate, tellurureas in very small amounts is thereby however not excluded. More recently used tellurium compounds have e.g. been described in U.S. Pat. Nos. 5,348,850; 5,541,047; 5,654,134. Further reductors as e.g. tin compounds as described in GB-A 789,823, amines, hydrazine derivatives, formamidinesulphinic acids, and silane compounds may be used, although care should be taken in order to prevent the emulsion from fog formation in an uncontrollable way. Normal amounts of selenium compounds are in the range from $1\times10^{-5}$–$1\times10^{-7}$ moles per mole of silver, whereas normal amounts of gold compounds (as gold chloride or gold thiocyanate) are in the range from $1\times10^{-5}$ to $2.5\times10^{-5}$ moles per mole of silver.

It may be recommended to use small amounts of reducing agents in order to counterbalance the restraining actions from spectral sensitizers, fog-restrainers or stabilizers as e.g. substituted heterocyclic mercapto compounds described in U.S. Pat. No. 5,242,791. Silver solvents may have a regulating role therein as e.g. thiocyanate ions. It is a common method to add chemical sensitizers after redispersion. Before starting chemical sensitization the surface of the tabular silver halide grains rich in silver bromide may be treated with slightly oxidizing compounds as e.g. toluene thiosulphonic acid and/or corresponding salts thereof in order to reduce small silver specks to grow to fog centers in an uncontrolled way.

In general terms light-sensitive tabular {111} silver halide grains rich in silver bromide may be spectrally sensitised with methine dyes such as those described by F. M. Hamer in "The Cyanine Dyes and Related Compounds", 1964, John Wiley & Sons. Dyes that may be used for the purpose of spectral sensitisation include cyanine dyes, merocyanine dyes, complex cyanine dyes, complex merocyanine dyes, homopolar cyanine dyes, hemicyanine dyes, styryl dyes and hemioxonol dyes. Spectral sensitization of said tabular grains or crystals, generally performed before or at last simultaneously with the chemical sensitization step proceeds with spectrally sensitizing compounds selected from the group consisting of benzimidazoles, benzoxazoles, or a combination thereof. In order to improve speed for the complex metal ion doped tabular silver haldie emulsion grains rich in silver bromide spectral sensitization with a combination of benzimidazolo- and benzoxazolocarbocyanines is preferred provided that absorption characteristics of the said combination of those green light-absorbing spectral sensitisers are such that spectral sensitization occurs in the preferred wavelength range between 520 and 580 nm, with a maximum absorption between 540 and 550 nm. An example of a useful spectral sensitiser of the oxacarbocyanine type is anhydro-5,5'-dichloro-3,3'-bis(n-sulphobutyl)-9-ethyloxacarbocyanine hydroxide or anhydro-5,5'-di-chloro-3,3'-bis(n-sulphopropyl)-9-ethyloxacarbocyanine hydroxide. A suitable mixture or combination of spectral sensitisers of the oxa- and imidacarbocyanine type is anhydro-5,5'-dichloro-3,3'-bis(n-sulphobutyl)-9-ethyloxacarbocyanine hydroxide or anhydro-5,5'-dichloro-3,3'-bis(n-sulphopropyl)-9-ethyloxacarbocyanine hydroxide together with anhydro-5,5'-dicyano-1,1'-diethyl-3,3'-di(2-acetoxy-ethyl)ethylimidacarbocyanine bromide.

Specific combinations of imidacarbocyanines and oxacarbocyanines which can be useful as spectral sensitizers to be added to emulsions of the present invention have been described in EP-Application No. 98200061, filed Jan. 13, 1998 and in EP-A's 0 443 453, 0 608 955 and 0 809 139 and in U.S. Pat. Nos. 5,296,345 and 5,338,655. Specific sensitizations with green-sensitizing imida-oxacarbo-cyanines have e.g. been described in U.S. Pat. Nos. 4, 594,317; 4,675,279; 4,701,405; 5,219,723; 5,376,523; 5,462,850. Spectral sensitizers having asymmetrical heterocycles may be useful and may even be preferred with respect to improvements in residual colouration after processing. Unsymmetrically chain substituted oxacarbocyanine dyes and/or imidacarbocyanine dyes suitable to improve dye stain and spectral sensitivity in the green short wavelength region have e.g. been given in JP-A 03-048235. Supersensitization with a symmetrical oxacarbocyanine dye in combination with a carbocyanine dye of e.g. the oxazole-imidazole type has been disclosed in U.S. Pat. Nos. 4,594,317 and 4,659,654. Specifically spectral sensitization with N-fluoro-alkyl substituted imidacarbocyanine dyes has been described in U.S. Pat. Nos. 4,675,279; 5,196,299; 5,210,014; and 5,466,822. It is clear that the choice of the spectral sensitzer or spectral sensitizing combination strongly depends on the application (silver halide photographic material) wherein the emulsion is used: coated in an emulsion layer of a material for exposure to blue/ultraviolet light clearly requires spectral sensitization to the blue/ultraviolet range of the wavelength spectrum as has e.g. been described for blue-sensitized emulsions and materials in EP-A 0 712 034 and as has been described in EP-Application Nos. 99201189 and 99201190, both simultaneously filed Apr. 16, 1999.

In classical emulsion preparation spectral sensitization traditionally follows the completion of chemical sensitization. It can however be advantageous to add an amount of a small amount of spectral sensitizing dye to the emulsion crystals just before cooling of the dispersion at the end of the growth stage, but in principle the addition of said dye may be performed at any stage of the precipitation, during or after redispersing or before, during or after chemical ripening. The addition can further be performed in one or more portions. So in U.S. Pat. No. 5,286,621 it has been shown that spectral sensitizer is added in amounts ranging from $10^{-5}$ to $5\times10^{-3}$ moles per mole of silver halide as a whole after completion of the precipitation or in several fractions during and after precipitation.

An important factor influencing growth of silver nuclei in the preparation of tabular grains rich in silver bromide is the choice of and the amount of protective colloid present in the reaction vessel or added simultaneously with one of the solutions added thereto during nucleation and further, eventually, after nucleation, during physical ripening before and/or during growth of the nuclei formed. So for emulsions according to the present invention said binder is gelatin, colloidal silica sol or cationic oxidized starch. The most well-known and practically used hydrophilic colloidal binder during precipitation of tabular grains rich in silver bromide is gelatin. The preparation of conventional lime-treated or acid treated gelatin has been described in e.g. "The Science and Technology of Gelatin", edited by A. G. Ward and A. Courts, Academic Press 1977, page 295 and next pages. The gelatin can also be enzyme-treated as described in Bull. Soc. Sci. Phot. Japan, No. 16, page 30 (1966). A preparation method of tabular grain emulsions wherein in the grain growth process use is made of gelatin derivatives with chemically modified $NH_2$-groups and wherein said gelatin has a specific methionine content has been described in e.g. EP-A 0 697 618. Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacryl-amide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerizable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even potato starch, whether or not modified as e.g. cationic oxidized starch. Further synthetic high molecular compounds described in JP-B-52-16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3), 24(1967) may be used as a dispersion medium. Also the crystal habit restraining agent described in EP-A 0 534 395 may be used. Part of gelatin may further be replaced with a synthetic or natural high-molecular material.

An interesting substitute for gelatin is silica which has been described in the published EP-A's 0 392 092, 0 517 961, 0 528 476 and 0 649 051 and 0 704 749. More specifically tabular grain emulsions prepared in colloidal silica as a protective colloid have been described in EP-A 0 677 773.

At the end of the precipitation, following all possible physical ripening steps, the emulsion mixture is normally cooled to about 40° C., before or after adding a flocculate being a polymeric compound as e.g. polystyrene sulphonic acid, providing as a anionic polymer a behaviour depending on pH. Under carefully controlled conditions of addition and stirring rate the pH of the said dispersing medium is adjusted with an acid to a value in order to get a qualitatively good flocculate. Said flocculate may become decanted and washed with demineralised water in order to remove the soluble salts. In the alternative an ultrafiltration washing procedure may be applied as has been disclosed e.g. in Research Disclosure, Vol. 102, October 1972, Item 10208, Research Disclosure Vol. 131, March, Item 13122 and Mignot U.S. Pat. No. 4,334,012.

Said ultrafiltration technique may be applied on-line during the whole precipitation, in order to reduce the increasing amount of water, thus avoiding dilution of the reaction vessel and increasing amounts of soluble salts like the mainly occurring potassium nitrate. Examples thereof have been described e.g. in EP-A 0 577 886. When the emulsion becomes washed by diafiltration making use therefor of a semipermeable membrane, a technique also called ultrafiltration, it is not necessary to use polymeric flocculating agents that may disturb the coating composition stability before, during or after the coating procedure. Such procedures are disclosed e.g. in Research Disclosure Vol. 102, October 1972, Item 10208, Research Disclosure Vol. 131, March, Item 13122 and U.S. Pat. No. 4,334,012. Redispersion may further be performed by addition of extra hydrophilic colloid. As a consequence values of gesi and/or sisi may be enhanced up to values desired in order to prepare stable coating solutions. It is clear however that any useful protective colloid cited hereinbefore as an alternative of gelatin or gelatin in modified form may be used.

Emulsions having tabular silver halide grains rich in silver bromide according to the present invention which have been prepared in order to be coated in light-sensitive silver halide layers of a film material should be stabilized in a suitable manner in order to provide a good fog-sensitivity(speed) relationship. A suitable way to stabilize such emulsions has e.g. been described in U.S. Pat. No. 5,654,134 wherein benzothiazolium compounds, mercapto containing agents and disulfides have been described; in U.S. Pat. No. 5,573,901, wherein thiosulfo compounds have been described in favour of pressure reduction and storage fog; in U.S. Pat. No. 5,374,513, wherein non-labile dichalcogenides, in U.S. Pat. No. 5,077,189, wherein dihydroxybenzene compounds or in U.S. Pat. No. 5,114,838 have been used as have been used as antifoggants, as wel as in EP-A 0 465 728, wherein mercapto-substituted pyrimidine derivatives have been proposed as stabilizers. The silver halide emulsions according to the present invention may further comprise as compounds preventing the formation of a high minimum density during the production or storage of photographic materials or during the photographic treatment thereof the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds which can be used as fog-inhibiting compounds are those described in Research Disclosure No. 17643 (1978), Chaptre VI. These fog-inhibiting agents or stabilizers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. Nos. 4,063,952 and with the onium compounds as disclosed in EP-A 0 408 143.

According to the present invention a light-sensitive silver halide photographic film material is further provided, wherein said material comprises a support and on one or both sides thereof at least one light-sensitive emulsion layer having a core-shell tabular grain emulsion as disclosed hereinbefore.

The photographic material comprising emulsions according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration. Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material comprising emulsions of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy (meth)acrylates, glycidyl (meth)acrylates, (meth) acrylamides, vinyl esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material comprising emulsions according to the present invention may comprise an antistatic layer to avoid static discharges during coating, processing and other handling of the material. Such antistatic layer may be an outermost coating like the protective layer or an after-layer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides or a polymer latex and the like.

Preferably,the photographic materials comprising emulsions according to the present invention are characterized by a neutral silver image tone, obtained after exposure and processing. It is well known that thin tabular emulsion grains may produce a brownish, yellow or even reddish image tone and therefore, tabular grains having an average thickness of 0.2 $\mu$m or more are preferred. On the other hand, a thickness between 0.20 and 0.3 $\mu$m may is not always preferred since thicker grains are characterized by a lower covering power of the developed silver, requiring a large amount of silver halide in the photographic material in order to obtain a satisfactory maximum density. Methods in order to prepare thicker tabular grains may however be applied as has already been described in U.S. Pat. Nos. 4,801,522; 5,028,521 and 5,013,641 and EP-A 0 569 075.

The non-neutral silver image colour of materials comprising emulsions according to the present invention can be corrected by increasing the optical density in the red region of the visible spectrum by adding suitable dyes to the support or any coated layer. This non-image wise colour correction method has been disclosed in references as e.g. JP-A's 03100645; 01029838; 01312536; 03103846; 03094249; 03255435; 61285445; EP-A 0 271 309 and in U.S. Pat. No. 4,861,702. This method however may result in an excessive base+fog density of the photographic material and therefore, an alternative way consists in an image-wise colour correction by using colour-forming developers, which are blue coloured in their oxidized form. Examples thereof are summarized in JP-A 03153234; 03154043 and 03154046. In JP-A's 03156447 and 03157645 the adsorption of a blue coloured dye as a function of exposure has further been disclosed.

Another method to improve the image tone of tabular grain emulsions according to the present invention consists of mixing them with cubic grains containing chloride as disclosed in EP-A 0 770 909. In addition, the photographic material comprising emulsions according to the present invention may comprise in an adjacent layer, but more preferably in the emulsion layer(s), a mercapto-substituted compound consisting of a group of atoms necessary to form a 5- or 6-membered ring. The compounds of the above formula are preferably added in an amount from $10^{-6}$ to $10^{-2}$, more preferably $10^{-5}$ to $10^{-3}$ mole per mole of silver in the emulsion layer(s). Representative examples of these compounds are given in U.S. Pat. No. 5,290,655.

According to the present invention emulsions are thus provided for use in light-sensitive layers of a photographic material as e.g. a colour photographic material or a black-and-white photographic material, a micrographic film material, a film material for aviation photography, cinefilm, hardcopy films, non-destructive testing materials, laser films, graphic and reprographic films, and radiographic film materials.

Single-side or double-side coated silver halide photographic materials comprising a support and coated thereon one or both sides respectively one or more hydrophilic light-sensitive layers, wherein at least one of said layers comprises a light-sensitive silver halide emulsion according to the present invention are more particularly provided.

More preferably according to the present invention said photographic material comprises on only one side of the support only one hydrophilic light-sensitive layer comprising an emulsion as disclosed herein, wherein light-sensitive tabular grains have a coverage of from 3.0 to 9.0 g/m$^2$, more preferably from 5.0 to 9.0 g/m$^2$, expressed as silver nitrate. The said material is particularly suitable for use in radiographic applications, and, more preferably, in mammographic applications wherein the desired contrast can thus be attained as set forth in the objects of the present invention.

Said radiographic film materials are, according to the present invention, used in radiographic screen/film combinations comprising a light-sensitive silver halide photographic film material as disclosed hereinbefore together with a supporting or self-supporting X-ray intensifying screen, characterized in that said supported or self-supporting X-ray intensifying screen essentially consists of luminescent phosphor particles emitting green light. In a preferred embodiment a radiographic screen/film combination is provided wherein said luminescent phosphor is $Gd_2O_2S$:Tb. Moreover a radiographic screen/film combination is provided wherein the total amount of coated silver halide in said film, expressed as an equivalent amount of silver nitrate, is less than 7.5 g/m$^2$.

For processing said film material after exposure with X-rays, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer without hardening agent;

fixing said material in a fixer,optionally without hardening agent;

rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may also be present.

As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342.

Especially preferred developers comprising ecologically acceptable developing agents such as ascorbic acid and derivatives thereof have been described in EP-A 0 732 619 and in U.S. Pat. Nos. 5,236,816; 5,593,817 and 5,604,082. Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure (further called "RD") No 371052, published Mar. 1, 1995, wherein a more general formula covering the formula of said developing agents has been represented. In order to reduce "sludge formation" which is favoured by solubilizing agents like sulphites, present in the developer as preservatives, a particularly suitable developer solution is the one comprising a reduced amount of sulphite and ascorbic acid which acts as a main developer and antioxidant as well and which is called "low-sludge" developer as has e.g. been described in EP-A 0 851 282 and in EP-Applications Nos. 98203412 and 98204079, filed Oct. 8 and Nov. 30, 1998, respectively.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odourless as illustrated in EP-A 0 908 764. If however aluminum ions are present in the fixer composition for whatever a reason, the presence of α-ketocarboxylic acid compounds is recommended as has been described in EP-A's 0 620 483 and 0 726 491 as well as in RD No. 16768, published March 1978.

It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated from very low amounts of emulsion crystals rich in silver chloride. Preferred minimum regeneration or replenishment amounts are from 20 to 200 ml/m$^2$, more preferred from 20 to 100 ml/m$^2$, and still more preferred from 20 to 50 ml/m$^2$ of developed material. Materials coated from higher amounts of silver will require the higher amounts of replenisher but in most practical cases replenishment amounts of less than 200 ml/m$^2$ are attainable. Replenishment of a developer comprising ascorbic acid or derivatives thereof and a 3-pyrazolidone derivative has been described in EP-A 0 573 700, wherein a method is disclosed for processing with constant activity image-wise exposed silver halide photographic material comprising the steps of developing photographic material in a continuous automatic way by means of a developing solution containing an ascorbic acid analogue or derivative and a 3-pyrazolidone derivative as developing agents and replenishing said developing solution by means of at least one replenishing solution having a higher pH than the developing solution. In an alternative method the replenisher is added as a powder. Other references related therewith are EP-A 0 552 511; U.S. Pat. No. 5,503,965 and further in EP-A 0 660 175, wherein a method of replenishment control is described. For the fixer preferred minimum regeneration or replenishment amounts are also from about 20 to 200 ml/m$^2$, more preferred from 20 to 100 ml/m$^2$ and still more preferred from 20 to 50 ml/m$^2$ of developed material. When aluminum ions are present in the fixer solution in order to effect hardening, it is necessary to adjust the pH of the fixer in the range from 4.2 to 4.6 in order to get the highest hardening reactivity and to suppress swelling with washing water in the washing or rinsing step. For hardened materials having a swelling degree of the hydrophilic layers of less than 250% and more preferably of less than 200% it is not required for the fixer pH to held constant in the pH range from 4.2 to 4.6 as mentioned before: in order to reduce irritating smell from sulphite ions in aqueous acidic medium which lead to sulphur dioxide vapour it is recommended to enhance pH to a value of 4.65 up to 5.00. A process whereby the quality of the fixer remains at an optimum level has been described in EP-A 0 872 764.

Although it is possible to use whatever a processing unit adapted to the requirements described hereinbefore to reach the objectives concerning a perfect link between rapid processing and ecology, the objects of this invention concerning processing have e.g. been realised in the processing unit CURIX HT 530, trade name product marketed by Agfa-Gevaert.

Further, according to the present invention, particularly with respect to mammographic applications a radiological method for obtaining a diagnostic image for mammography is offered, said method comprising the steps of (i) composing a film-screen system according to the present invention by bringing a photographic material as disclosed herein-before into contact with a radiographic X-ray conversion screen; and (ii) subjecting said film-screen system to exposure with X-rays, emitted from an X-ray generating device with a tube voltage of 20 kV to 40 kV; and (iii) processing said photographic material in a total dry-to-dry processing time of from 38 seconds up to 210 s, and more preferably in a time of from 45 s up to 90 s, by the steps of developing, fixing, rinsing or washing and drying.

According to the present invention, the same method is applied with respect to e.g. chest-imaging applications, apart for (i) composing a film-screen system according to the present invention by bringing a duplitized or double-side coated photographic material into contact with a pair of radiographic X-ray conversion screens; and (ii) subjecting said film-screen system to exposure with X-rays, emitted from an X-ray generating device with a tube voltage of 70 kV to 100 kV; the processing step remaining the same.

Having described in detail preferred embodiments of the current invention, it will now be apparent to those skilled in the art that numerous modifications can be made therein without departing from the scope of the invention as defined in the appending claims.

6. EXAMPLES

6.1 Example 1

Preparation of Tabular Emulsion TC1 (comparative emulsion)

To a solution of 7.5 g of an oxidized gelatin in 3 l of demineralized water, adjusted to a pBr value of 2.39 by adding KBr and a pH of 1.8 by adding $H_2SO_4$, were added by a double jet method aqueous solutions of 1.96 M $AgNO_3$ (hereinafter referred to as S1) and 1.96 M KBr (hereinafter referred to as S2): 7.35 ml of S1 and 7.35 ml of S2 were added in a time interval of 9 seconds. During this period, the reaction mixture was maintained at 45° C. When the addition was completed, stirring continued during 2 minutes and then, temperature was increased up to 70° C. over a period of 25 minutes, followed by the addition, after another time of 2 minutes, of 500 ml of an aqueous gelatinous solution of 10 wt % of gelatin. After another time interval 2 minutes after said addition a NaOH solution was added over a time period of one minute in order to adjust pH to 6.0. Then stirring continued for 6 minutes at a temperature held constant at 70° C. and S2 was added by a single jet at 7.5 ml/min over a period of 5.5 minutes. Then S1, at a constant flow rate of 7.5 ml/min, and S2 at a flow rate, controlled in order to maintain pAg at 8.85, were added in a double jet over a period of 1 minute. This double jet was continued during another period of 33 minutes and 22 seconds, while the flow rate of S1 was linearly increased up to 23.1 ml/min and pAg was maintained at 8.85. This period was called "first growth step". 5 minutes after the completion of said double jet addition, S1 was added at 7.5 ml/min during 7 minutes and 30 seconds. Then another double jet started of S1 at 7.5 ml/min during 1 minute and an aqueous solution of 1.93 M KBr and 0.03 M KI (solution S3) at a controlled flow rate to maintain pAg at 7.38. This double jet was continued during another period of 41 minutes and 2 seconds, while the flow rate of S1 was linearly increased from said 7.5 ml/min up to 36.9 ml/min and pAg was maintained at 7.4. The average grain size of the silver bromoioide tabular {111} emulsion grains thus prepared, expressed as equivalent volume diameter, was 0.70 μm, the average thickness was 0.21 μm and the variation coefficient was 0.25. The iodide content was 1 mol %.

After washing, gelatin and water were added in order to obtain a silver halide content of 245 g/kg, expressed as $AgNO_3$, and a gelatin content of 83 g/kg. To 2 kg of this emulsion, of which pH was adjusted to 5.5, were added consecutively 4 ml of a 10 wt. % KSCN solution, 0.2 ml of a $4.76\times10^{-3}$ M solution of sodium toluenethiosulphonate in methanol, 780 ml of a 0.25 wt. % solution of anhydro-5,5'-dichloro-3,3'-bis(n-butyl-4-sulphonate)-9-ethyl-benzoxacarbocyanine triethylammonium salt, 9 mg sodium thiosulphate, 10 ml of a solution containing $1.46\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole and this mixture was chemically ripened during 4 hours at 48° C. After cooling, a preservative was added.

Preparation of Tabular Emulsion TI1 (inventive example)

The preparation scheme was the same as for the preparation of tabular emulsion TC1, except for the first growth step wherein the double jet precipation was continued during another period of 22 minutes and 24 seconds instead of 33 minutes and 22 seconds as for TC1, while the flow rate of S1 was linearly increased up to 18.0 ml/min and while the flow rate of S2 was adjusted in order to maintain a pAg of 8.85. After the completion of said double jet addition, S1 was added at 7.5 ml/min during 10 minutes while introducing over the same period 147 ml of an aqueous solution of hexacyanoruthenate trihydrate (containing 0.419 g/l of the dopant) and S2 at a flow rate in order to maintain the pAg value constant. Introducing such an amount of dopant solution, corresponding with a locally added amount of 1000 p.p.m., was performed in order to have a global amount of dopant corresponding with 50 p.p.m. over the whole volume of the tabular grain. A second growth step was then performed by double jet precipitation of 150 ml of solution S1 at a starting rate of 7.5 ml/min. and an end rate of 9 ml/min., adding solution S2 at a rate in order to maintain a pAg of 8.85. A following (third) neutralization step was performed by introduction of solution S1 by single-jet at a rate of 7.5 ml/min. during 7 min. 30 s and was immediately followed by another double jet addition of S1 at 7.5 ml/min during 1 minute and an aqueous solution of 1.93 M KBr and 0.03 M KI (solution S3) at a controlled flow rate to maintain pAg at 7.38. This double jet was continued during another period of 41 minutes and 2 seconds, while the flow rate of S1 was linearly increased from said 7.5 ml/min up to 36.9 ml/min and pAg was maintained at 7.4. The average grain size of the silver bromoioide tabular {111} emulsion grains thus prepared, expressed as equivalent volume diameter, was 0.70 μm, the average thickness was 0.21 μm and the variation coefficient was 0.25. The iodide content was 1 mol %. The chemical ripening was performed in just the same way (same amounts of chemicals and order of addition) as described for emulsion TC1. The dopant agent was thus added after a relative amount of precipitated silver of about ⅕ of the total amount, in an annular ring corresponding with a precipitated amount of about 5% of silver nitrate added and before growing the tabular grains with an amount of about 75% of the total amount of precipitated silver.

Preparation of Tabular Emulsion TI2

Same emulsion as TI1, except for the local addition at the same moment in the preparation scheme of 2000 p.p.m. in order to get a global amount of the same dopant of 100 p.p.m. instead of 50 p.p.m.

The same chemical ripening (order of addition, amounts of chemical ripening agents) was applied as for tabular grain emulsions TC1 and TI1. Following coating agents, summarized in Table 1, were added to the emulsion before coating the emulsion layer. Coating agents have further been summarized hereinafter in Table 2, and were added to the protective coating before coating the protective antistress layer.

In Table 2 hereinafter (a) represents Polythioether A which is a modified poly-epichloorhydrine having an average chain length of approximately 20 monomer units and of which about 50% of the chloride groups have been replaced by a —S—$CH_2$—CHOH—$CH_2$OH substituent.

TABLE 1

| Compound (amounts per mole silver halide) | Emulsion layer |
|---|---|
| 5,5'-dichloro-3,3'-bis(n-butyl-4-sulphonate)-9-ethylbenzoxacarbocyanine, anhydrous triethylammonium salt | 50 mg |
| 4-hydroxy-6-methyl-1,3,3a,7-tetraazaindene | 87 mg |
| 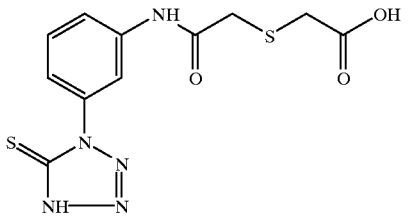 | 33 mg |
| Sorbitol | 15.5 g |
| Polyethylacrylate, latex plasticizer | 12 g |
| Phloroglucinol | 195 mg |
| Resorcinol | 2.8 g |
| potassium bromide | 160 mg |
| Polydextran (M.W. 10,000) | 15 g |

TABLE 2

| Compound | Amounts per $m^2$ |
|---|---|
| Gelatin | 1.1 g |
| Polymethylmethacrylate spacing agent (average particle diameter 3 mm) | 15 mg |
| chromium acetate | 5.5 mg |
| 4-hydroxy-6-methyl-1,3,3a,7-tetraazaindene | 82 mg |
| bis-metasulphophenyl-disulphide | 4 mg |
| $CF_3$—$(CF_2)_6$—COOH.NH3 | 7.5 mg |
| $CF_3$—$(CF_2)_6$—CONH—$(CH_2CH_2O)_{17-20}$—H | 19 mg |
| Phenol | 150 mg |
| 1-phenyl-4-methyl-3-pyrazolidone | 0.13 mg |
| Mobilcer Q (a paraffin wax, trade name product from MOBIL OIL) | 25 ml |
| polythioether A[(a)] | 5 mg |
| formaldehyde (added just before coating) | 100 mg |

Coating of the Materials

The photographic materials according to these examples comprise one emulsion layer and one protective layer. The coating solutions of the emulsion layers were prepared by adding solutions of the compounds indicated in Table 1 to the melted emulsion while stirring. The coating solution of the protective layer is given in Table 2. After adjusting pH to 6.7, the viscosity and surface tension of the coating solutions were optimised according to the requirements of the coating method. The emulsion layer(s) and the protective layer were coated simultaneously on one side of a substrated polyester support having a thickness of 175 $\mu$m by means of conventional coating techniques. The silver coverage of the emulsions was about 7 g/$m^2$, expressed as an equivalent amount of silver nitrate. Bis-vinylsulfonylmethyl ether was added in order to reduce the swelling degree of the unexposed material during 3 minutes in demineralized water of 25° C. to 200%.

Separate strips of the coated materials were subsequently exposed for the same exposure time of 2 seconds to white light on exposure apparatus BEL 1043, said light being filtered with a Corning 4010 filter. Development proceeded for 12 seconds in developer G138® and thereupon, the developed photographic strips were fixed in conventional fixer G334®, and after rinsing in water the film strips were allowed to dry. Sensitometric properties of these film strips are given in Table 3.

This Table 3 shows the sensitometric results in terms of fog F, speed S (figures multiplied with a factor of 100, measured at a density of 1.4 above fog: the lower the figure, the more sensitive is the emulsion), "toe" contrast (gradation) TG (measured between 0.1 and 1.4 above fog), overall contrast GG (measured between 0.25 and 2.0 above fog), and "shoulder" contrasts or gradation SG1 and SG2 (measured between 1.4 and 2.5 above fog and 0.8 and 1.6 above fog respectively), of the photographic strips prepared and exposed as set forth above. Contrast values have all been multiplied with a factor of 100.

TABLE 3

| Matl. No | F | S | TG | GG | SG1 | SG2 |
|---|---|---|---|---|---|---|
| TC1 | 0.03 | 157 | 183 | 241 | 287 | 285 |
| TI1 | 0.04 | 137 | 285 | 375 | 432 | 420 |
| TI2 | 0.03 | 150 | 312 | 405 | 449 | 466 |

As can be concluded from the Table 3 hereinafter the presence in the light-sensitive silver halide photographic emulsions, more particularly in core-shell {111} tabular grains rich in silver bromide (pure AgBr core up to ⅓ of all silver precipitated; AgBr(I) in the outermost shell), of hexacyano ruthenate salt as a dopant (locally concentrated in a band corresponding with 5% of silver nitrate precipitated, after precipitation of 20% of the total amount of silver), in total amounts of 50 and 100 p.p.m. respectively leads to an increased contrast over the whole sensitometric curve without loss in speed versus a materials coated from tabular grains without said sahllow electron trap dopant having the same halide composition.

Although enhanced amounts of dopants (see TI2 versus TI1) show a decrease in speed, contrasts are still increasing and the global sensitivity or speed still exceeds the one of emulsion TC1.

6.2 Example 2

Preparation of Tabular Emulsion TC2 (comparative emulsion)

To a solution of 7.5 g of an oxidized gelatin in 3 l of demineralized water, adjusted to a pBr value of 2.39 by adding KBr and a pH of 1.8 by adding $H_2SO_4$, were added by a double jet method aqueous solutions of 1.96 M $AgNO_3$ (hereinafter referred to as S1) and 1.20 M KBr (hereinafter referred to as S2): 6 ml of S1 and 6 ml of S2 were added in a time interval of 9 seconds. During this period, the reaction mixture was maintained at 45° C. When the addition was completed, stirring continued during 2 minutes and then, temperature was increased up to 70° C. over a period of 25 minutes, followed by the addition, after another time of 2 minutes, of 500 ml of an aqueous gelatinous solution of 10 wt % of gelatin. After another time interval 2 minutes after said addition a NaOH solution was added over a time period of one minute in order to adjust pH to 6.0. Then stirring continued for 6 minutes at a temperature held constant at 70° C. and S1 was added by a single jet at 2.5 ml/min over a period of 1.5 minutes. Then Si, at a constant flow rate of 2.5 ml/min, and S2 at a flow rate, controlled in order to maintain pAg at 7.68, were added in a double jet over a period of 6 minutes. This double jet addition was continued in order to add 833 ml of S2 during another period of 1 hour, 35 minutes and 10 seconds, while the flow rate of S1 was linearly increased up to 15 ml/min and pAg was maintained at 7.68. This period was called "first growth step". 5 minutes after the completion of said double jet addition, S1 was added at a rate of 7.5 ml/min during 9 minutes and 50 seconds, while maintaining the pAg value at 7.68 when adding S3 (solution of 1.20 N of KBr and 0.018 N of KI) at a variable rate. A second growth step was performed wherein 1519 ml of S1 were added in 75 minutes (starting velocity 7.5 ml/min. was increased up to 33 ml/min. at the end). S3 was added in order to maintain the pAg at a value of 7.68.

After washing, gelatin and water were added in order to obtain a silver halide content of 245 g/kg, expressed as $AgNO_3$, and a gelatin content of 83 g/kg. To 2 kg of this emulsion, of which pH was adjusted to 5.5, were added consecutively 4 ml of a 10 wt. % KSCN solution, 0.2 ml of a $4.76\times10^{-3}$ M solution of sodium toluenethiosulphonate in methanol, 780 ml of a 0.25 wt. % solution of anhydro-5,5'-dichloro-3,3'-bis(n-butyl-4-sulphonate)-9-ethyl-benzoxacarbocyanine triethylammonium salt, 7 mg sodium thiosulphate, 6 ml of a solution containing $1.46\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole and this mixture was chemically ripened during 4 hours at 48° C. After cooling, a preservative was added.

Preparation of Tabular Emulsion TI3 (inventive example)

The preparation scheme was the same as for the preparation of tabular emulsion TC2 hereinbefore, except for the first growth step wherein the double jet precipitation was continued during another period of 67 minutes and 16 seconds instead of 95 minutes and 10 seconds as for TC2, while the flow rate of S1 was linearly increased up to 11.25 ml/min and while the flow rate of S2 was adjusted in order to maintain a pAg of 7.68. After the completion of said double jet addition, 122.6 ml of solution S1 was added together with S2 at a rate in order to provide a constant pAg value of 7.68, while simultaneously introducing over the same period 29.4 ml of an aqueous solution of hexacyanoruthenate trihydrate (containing 0.419 g/l of the dopant) thereby introducing such an amount of dopant solution, corresponding with a locally added amount of 200 p.p.m., in order to have a global amount of dopant corresponding with 10 p.p.m. over the whole volume of the tabular grain. A second growth step was then performed by double jet precipitation of 73.7 ml of solution S1 at a constant rate of 7.5 ml/min. while adding solution S3 at a rate in order to maintain a pAg of 7.68. A following (third) growth step was performed by introduction of solution S1 and solution S3 by double-jet addition at a starting rate of 7.5 ml/min. during 21 min. 28, linearly increasing from said 7.5 ml/min up to 35.44 ml/min maintaining pAg at a value of 7.68. The average grain size of the silver bromoioide tabular {111} emulsion grains thus prepared, expressed as equivalent volume diameter, was 0.76 μm, the average thickness was 0.35 μm and the variation coefficient was 0.25. The iodide content was 1 mol %. The chemical ripening was performed in just the same way (same amounts of chemicals and order of addition) as described for emulsion TC1.

The dopant agent was thus added after a relative amount of precipitated silver of about ⅕ of the total amount, in an annular ring corresponding with a precipitated amount of about 5% of silver nitrate added and before growing the tabular grains with the left amount of about 75% of the total amount of precipitated silver.

Preparation of Tabular Emulsion TC4

Same emulsion as TC3, except for the local addition at the same moment in the preparation scheme of 1000 p.p.m. in order to get a global amount of the same dopant of 50 p.p.m. instead of 10 p.p.m. as for TC3.

The same chemical ripening (order of addition, amounts of chemical ripening agents) was applied as for tabular grain emulsions TC2 and TC3.

Preparation of Tabular Emulsion TC5

Same emulsion as TC3, except for the local addition at the same moment in the preparation scheme of 2000 p.p.m. in order to get a global amount of the same dopant of 100 p.p.m. instead of 10 p.p.m. as for TC3.

The same chemical ripening (order of addition, amounts of chemical ripening agents) was applied as for tabular grain emulsions TC2, TC3 and TC4.

The emulsions were coated in materials, exposed and processed in the same way as in Example 1. Sensitometric results, having the same significance as in Example 1 have been summarized in Table 4.

TABLE 4

| Matl. No | F | S | TG | GG | SG1 | SG2 |
|---|---|---|---|---|---|---|
| TC2 | 0.03 | 123 | 229 | 285 | 255 | 321 |
| TI3 | 0.03 | 132 | 245 | 307 | 306 | 340 |
| TI4 | 0.03 | 150 | 287 | 352 | 373 | 389 |
| TI5 | 0.03 | 163 | 314 | 390 | 427 | 434 |

As can be concluded from the results in Table 4, higher amounts of dopants clearly cause gradations to increase, but, if compared with the results obtained in Table 3, a remarkable loss in speed is obtained when higher amounts of dopant are used, said loss in speed even leading to a lower speed for the lowest amount of dopant, if compared with the comparative example.

Opposite to the results summarized in Table 3 speed is insufficient, even for low amounts (10 p.p.m.) of dopant and there is even a further loss in speed as higher amounts of dopants are present.

This is clearly related with differences in iodide distribution over the volume of the core-shell structured silver bromoiodide tabular grain as the silver bromide core is extending up to 50% of all silver precipitated and as AgBr(I) is present in a shell not exceeding 50% of all silver precipitated.

Having described in detail illustrative examples of the current invention, it will now be apparent to those skilled in the art that numerous modifications can be made therein without departing from the scope of the invention as defined in the appending claims.

What is claimed is:

1. Light-sensitive silver halide photographic emulsion comprising a binder and core-shell tabular grains, wherein said core is more rich in silver bromide than said shell, characterized in that said grains contain, in the core of said core-shell tabular grains representing an amount of precipitated silver halide extending up to less than 50% of all precipitated silver halide, a ruthenium complex compound as a sole complex compound providing shallow electron traps.

2. Light-sensitive silver halide photographic emulsion according to claim 1, wherein said core represents an amount of precipitated silver halide extending up to at most 40% of all precipitated silver halide.

3. Emulsion according to claim 1, wherein said grains have silver bromide in an average amount of at least 95 mole %.

4. Emulsion according to claim 1, wherein said grains have silver iodide in an average amount of at most 3 mole %.

5. Emulsion according to claim 1, wherein said tabular grains have a {111} crystal habit with an aspect ratio of more than 2, an average equivalent crystal diameter of at least 0.5 μm, an average thickness of from 0.06 to 0.30 μm and wherein said grains account for a total projected area of at least 90% with respect to all grains.

6. Emulsion according to claim 1, wherein said ruthenium complex compound providing shallow electron traps is a ruthenium cyanate salt complex.

7. Emulsion according to claim 1, wherein said ruthenium complex compound is present in amount of from 1 ppb up to 100 ppm versus silver.

8. Emulsion according to claim 1, wherein said ruthenium complex compound is locally concentrated in a band corresponding with less than 10% of silver nitrate precipitated, after precipitation at least 10% of the total amount of silver.

9. Emulsion according to claim 1, wherein said ruthenium complex compound is locally concentrated in a band corresponding with at most 5% of silver nitrate precipitated, after precipitation of 20% of the total amount of silver.

10. Single-side or double-side coated silver halide photographic material comprising a support and coated thereon one or both sides respectively one or more hydrophilic light-sensitive layers, wherein at least one of said layers comprises a light-sensitive silver halide emulsion according to claim 1.

* * * * *